US009856062B2

(12) United States Patent
Wagner, Sr. et al.

(10) Patent No.: US 9,856,062 B2
(45) **Date of Patent: *Jan. 2, 2018**

(54) METHOD FOR PACKAGING A PACK COMMODITY, AND PACKAGE FOR A PACK COMMODITY

(71) Applicant: Felix Waldner GmbH, Linz (AT)

(72) Inventors: Hugo Wagner, Sr., Linz (AT); Hugo Wagner, Jr., Linz (AT)

(73) Assignee: Felix Waldner GmbH, Linz (AT)

( * ) Notice: Subject to any disclaimer, the term of this patent is extended or adjusted under 35 U.S.C. 154(b) by 501 days.

This patent is subject to a terminal disclaimer.

(21) Appl. No.: 14/558,830

(22) Filed: Dec. 3, 2014

(65) Prior Publication Data

US 2015/0083631 A1 Mar. 26, 2015

Related U.S. Application Data

(63) Continuation of application No. 13/243,048, filed on Sep. 23, 2011, now Pat. No. 9,205,964.

(30) Foreign Application Priority Data

Sep. 27, 2010 (EP) ..... 10180327

(51) Int. Cl.
*B65D 75/00* (2006.01)
*B65D 75/30* (2006.01)
(Continued)

(52) U.S. Cl.
CPC ..... *B65D 75/006* (2013.01); *B65B 11/50* (2013.01); *B65B 11/585* (2013.01); *B65B 35/50* (2013.01);
(Continued)

(58) Field of Classification Search
CPC ..... B65B 9/135; B65B 11/00; B65B 11/02; B65B 11/50; B65B 11/58; B65B 11/585;
(Continued)

(56) References Cited

U.S. PATENT DOCUMENTS 2,445,152 A 7/1948 Poole
3,562,392 A 2/1971 Mylius
(Continued)

FOREIGN PATENT DOCUMENTS

DE 1922180 11/1974
DE 2338737 2/1975
(Continued)

OTHER PUBLICATIONS

EPO machine translation of DE 1922180 A1, retrieved from espacenet.com, dated May 15, 2017, 10 pages.*

*Primary Examiner* — Stephen F Gerrity
(74) *Attorney, Agent, or Firm* — Verrill Dana, LLP; John W. Powell

(57) ABSTRACT

A method for packaging a pack commodity, including providing a support element for supporting the pack commodity. The method also includes placing a first packaging material sheet onto the support element and disposing the pack commodity on the first packaging material sheet such that a portion of the first packaging material sheet comes to lie between the support element and the pack commodity, wherein the first packaging material sheet protrudes over the pack commodity. Next, a second packaging material sheet is placed onto an upper side of the pack commodity so that the second packaging material sheet protrudes over the pack commodity. The first packaging material sheet is joined, in some regions, to the second packaging material sheet. The first and the second packaging material sheets are adhesively joined in a respective, predetermined first region, along a
(Continued)

periphery of the support element, such that they can be separated and re-joined.

13 Claims, 7 Drawing Sheets

(51) Int. Cl.

| | |
|---|---|
| ***B65B 11/58*** | (2006.01) |
| ***B65B 11/50*** | (2006.01) |
| ***B65B 51/02*** | (2006.01) |
| ***B65B 51/06*** | (2006.01) |
| ***B65B 53/02*** | (2006.01) |
| ***B65B 53/06*** | (2006.01) |
| ***B65D 71/00*** | (2006.01) |
| ***B65D 71/04*** | (2006.01) |
| ***B65B 35/50*** | (2006.01) |
| ***B65B 53/00*** | (2006.01) |
| ***B65D 19/00*** | (2006.01) |

(52) U.S. Cl.
CPC ..... *B65B 51/02* (2013.01); *B65B 51/06* (2013.01); *B65B 53/00* (2013.01); *B65B 53/02* (2013.01); *B65B 53/066* (2013.01); *B65D 19/0004* (2013.01); *B65D 71/0088* (2013.01); *B65D 71/04* (2013.01); *B65D 75/30* (2013.01)

(58) Field of Classification Search
CPC ..... B65B 35/50; B65B 51/02; B65B 51/06; B65B 53/00; B65D 71/0088; B65D 75/006; B65D 75/30; B65D 2571/00012; B65D 2571/00018
USPC ..... 53/400, 441, 447, 459, 461, 464, 540, 53/556, 567, 383.1, 218; 206/204, 386, 206/597, 524.4
See application file for complete search history.

(56) References Cited

U.S. PATENT DOCUMENTS

| | | | |
|---|---|---|---|
| 3,667,598 | A | 6/1972 | Zelnick et al. |
| 3,855,756 | A | 12/1974 | Sweeney et al. |
| 3,893,279 | A | 7/1975 | Bostrom |
| 3,995,410 | A | 12/1976 | Berghgracht |
| 3,997,054 | A | 12/1976 | Berghgracht |
| 4,000,815 | A | 1/1977 | Wingbro et al. |
| 4,060,957 | A | 12/1977 | Birkenfeld et al. |
| 4,157,754 | A | 6/1979 | Bartsch et al. |
| 5,042,235 | A | 8/1991 | Hannen et al. |
| 5,729,962 | A | 3/1998 | Dirx |
| 5,945,147 | A | 8/1999 | Borchard |
| 5,983,598 | A | 11/1999 | Quinones |
| 9,205,964 | B2 * | 12/2015 | Wagner, Sr. et al. ... B65B 53/02 |
| 2002/0023412 | A1 | 2/2002 | Usui et al. |
| 2004/0149619 | A1 | 8/2004 | Dybro et al. |
| 2008/0216450 | A1 | 9/2008 | MacLeod et al. |
| 2009/0020529 | A1 | 1/2009 | Stottmeister |

FOREIGN PATENT DOCUMENTS

| | | |
|---|---|---|
| DE | 2724306 | 12/1978 |
| DE | 3521416 | 12/1986 |
| DE | 602004007049 | 2/2008 |
| EP | 49974 | 4/1982 |
| EP | 0249534 | 12/1987 |
| FR | 1245523 | 11/1960 |
| FR | 2161527 | 7/1973 |
| GB | 1372671 | 11/1974 |

* cited by examiner (A)

(A')

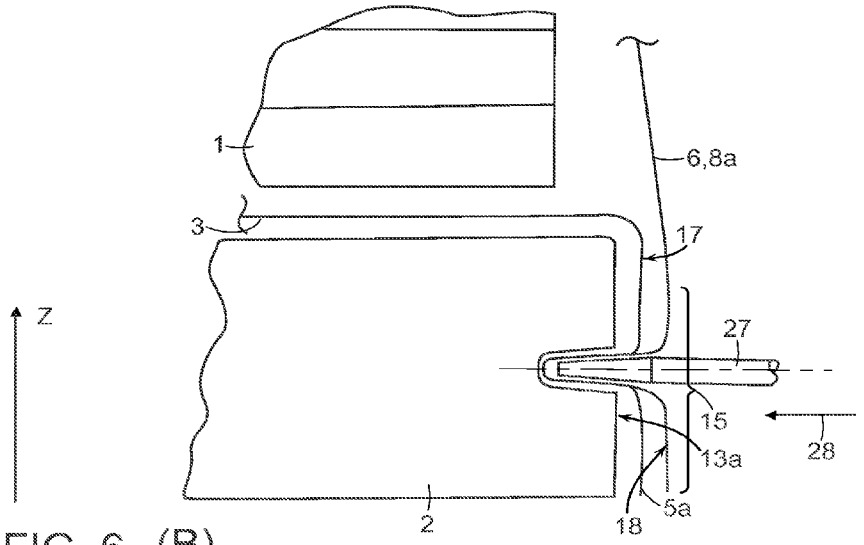
FIG. 6 (B)
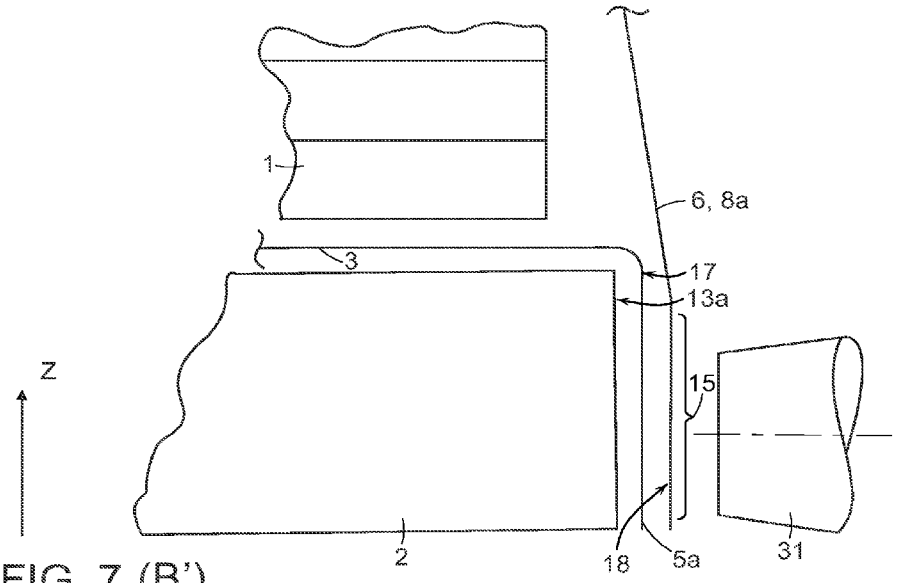
FIG. 7 (B')

METHOD FOR PACKAGING A PACK COMMODITY, AND PACKAGE FOR A PACK COMMODITY

CROSS REFERENCE TO RELATED APPLICATIONS

This application is a continuation application of U.S. application Ser. No. 13/243,048, filed on Sep. 23, 2011, which claims the priority of European Patent Application No. 10180327.8, filed Sep. 27, 2010. The contents of the prior application are incorporated herein by reference.

The present invention relates to a method for packaging a pack commodity, in particular a commodity stack constituted by a plurality of commodity pieces. Further, the invention relates to a package for a pack commodity.

Although the present invention can be applied in connection with a very great variety of commodities and goods to be packaged, the present invention and the set of problems on which it is based are explained more fully in the following on the basis of the packaging of a commodity stack in the form of a set of metal sheets constituted by individual sheet-metal plates stacked over one another.

When a stack of sheet-metal plates laid on one another is transported from the manufacturer or dealer to a purchaser, or if it is necessary for the stack to be stored beforehand, it is desirable for the metal sheets that are stacked on one another to be protected against dirt and, in particular, moisture during transport or storage, in order that the goods reach the customer in a state of perfect quality. In the case of metal sheets, it is necessary, in particular, to prevent the sheets from starting to corrode. In the case of galvanized steel sheets or items, it is sought, for example, to prevent unsightly white rust from forming on their surfaces. To prevent the ingress of dirt and moisture, the set of metal sheets can be enclosed by an air-tight packaging cover, in order to prevent moist air masses from being admitted from the storage or transport environment.

A method for tight packaging of a commodity stack on a pallet has been described in DE 35 21 416 A1. In the case of this method, a shrink hood drawn over the commodity stack is shrunk progressively in the vertical direction through the use of hot gas. Finally, the shrink hood is welded tightly to a film that is present between the commodity stack and the pallet and that projects over the edge of the pallet.

Such already known methods for the packaging of commodities have the disadvantage, however, that the completed package is difficult to open manually, and requires a tool, for example a knife or the like. This is precisely the case even if the pack commodity is metal sheets having possibly sharp edges and corners, and the use of a somewhat stronger and more tear-resistant packaging material, for instance a thicker film, therefore appears expedient.

The object of the present invention therefore consists in disclosing a method that enables a pack commodity to be packaged in such a way that the pack commodity, on the one hand, is protected against the ingress of dirt and moisture and, on the other hand, the package can be easily opened by hand without a tool. Further, it is an object of the present invention to provide a corresponding package for a pack commodity.

There is accordingly proposed a method for packaging a pack commodity, in particular a commodity stack constituted by a plurality of commodity pieces, which method comprises the following steps:

- providing a support element, in particular a pallet, for supporting the pack commodity;

- placing a first packaging material sheet onto the support element;
- disposing the pack commodity on the first packaging material sheet such that a portion of the first packaging material sheet comes to lie between the support element and the pack commodity, and the first packaging material sheet protrudes over the pack commodity;
- placing a second packaging material sheet onto an upper side of the pack commodity such that the second packaging material sheet protrudes over the pack commodity; and
- in some regions joining the first packaging material sheet to the second packaging material sheet.

In the joining in some regions, the first packaging material sheet and the second packaging material sheet are adhesively joined in a respective, predetermined first region, along a first portion of a periphery of the support element, such that they can be separated and, in particular, can be re-joined.

Further provided according to the invention is a package for a pack commodity, in particular a commodity stack constituted by a plurality of commodity pieces, which package is produced, in particular, by means of the method according to the invention. The package has a support element, in particular a pallet, for supporting the pack commodity. Further, the package has a first packaging material sheet and a second packaging material sheet, the first and the second packaging material sheet being joined to one another in some regions. The first packaging material sheet and the second packaging material sheet are adhesively joined in a respective, predetermined first region, along a first portion of a periphery of the support element, such that they can be separated and, in particular, can be re-joined.

The idea of the present invention consists in joining the first and the second packaging material sheet to one another in a different way along two different portions of the periphery of the support element. Whereas the two packaging material sheets are adhesively and separably joined to one another, along the first portion of the periphery, in the first region, the join along the second portion is effected in such a way that the two packaging material sheets can only be separated again from one another by destroying the package of the pack commodity. Because of the separable adhesive join along the first portion, on the one hand a tight join of the packaging material sheets is achieved there, on the other hand the regions of the two packaging material sheets that adhere to one another can be manually parted from one another for the purpose of opening the package along the first portion. The other type of join of the first and second packaging material sheets, along the second portion of the periphery of the support element, is preferably instrumental in preventing the two packaging material sheets from parting completely from one another in an impractical manner as the package is opened. In particular, the forces required for separating the first packaging material sheet from the second packaging material sheet, along the second portion, are substantially greater than those necessary for parting the two packaging material sheets in the first region, along the first portion.

Further, the joining of the first and the second packaging material sheet in the first region can be effected, in particular, in such a way that the packaging material sheets can be re-joined in the first region, for example by re-adhesion. This is likewise advantageous since, if the pack commodity is a commodity stack, it is easy to remove only a proportion of the packaged commodity from the package. For continued storage of the rest of the commodity to be removed at a later point in time, the package can be re-closed rapidly and easily, in a manner that is secure against corrosion. Moreover, advantageously, it also becomes possible to inspect the stored or transported pack commodity, and subsequently to re-close the package in a manner that is secure against corrosion. This is advantageous even if the pack commodity, for example, is not a commodity stack, but a single piece such as, for instance, a machine.

Advantageous embodiments and developments of the invention are disclosed by the further dependent claims considered in combination with the appended figures of the drawing.

In an embodiment of the invention, the respective first region is marginal regions of the first and second packaging material sheet. Equally, in this embodiment, the respective second region is likewise marginal regions of the first and second packaging material sheet. As a result, advantageously, packing material can be saved, and economic packaging of the pack commodity can be achieved.

In the case of a further embodiment of the invention, a part of the first packaging material sheet that projects over the pack commodity is folded away from the support element towards side surfaces of the pack commodity. In particular, in the case of this embodiment, in the joining of the first packaging material sheet to the second packaging material sheet, an underside of the first packaging material sheet is brought into overlapping contact, in the first and the second region, with an underside of the second packaging material sheet. As a result, for example, a more attractive appearance of the packaged pack commodity can be achieved.

In the case of another embodiment of the invention, a part of the first packaging material sheet that projects over the pack commodity is folded away from the pack commodity towards side surfaces of the support element. In particular, in the case of this embodiment, in the joining of the first packaging material sheet to the second packaging material sheet, an upper side of the first packaging material sheet is brought into overlapping contact, in the first region and the second region, with an underside of the second packaging material sheet. It is thereby possible to prevent, for example, water from penetrating between the first packaging material sheet and the support element, which can be advantageous precisely in the case of a support element made of wood.

In the case of a further improvement, the first packaging material sheet is additionally joined, along the first portion of the periphery of the support element, to the side surfaces of the support element. This measure enables the package to be subsequently opened more easily by manually separating the first packaging material sheet from the second packaging material sheet, since it is not necessary to hold on to the first packaging material sheet with the hand.

According to a development of the invention, the first packaging material sheet, for the purpose of joining to the side surfaces of the support element, is stitched, by means of a blunt arbor, to the side surfaces of the support element, or is attached by means of staples. This development makes it possible to achieve a rational and, at the same time, reliable fastening to the side surfaces of the support element. However, other types of attaching or stitching are also possible.

In an embodiment of the invention, for the purpose of adhesive joining along the first portion, a double-sided adhesive tape is applied, in the respective first region, to the first packaging material sheet or to the second packaging material sheet. As a result, the joining in the first region can be realized in a cost-effective manner. Further, the use of double-sided adhesive tape allows a locally very flexible choice of the position and extent of the first region, which can be advantageous precisely if pack commodities or commodity stacks of very different sizes, for example stacks of metal sheets cut to different sizes, are to be packaged in succession. The double-sided adhesive tape can be stuck on directly on site as required during the packaging operation. Furthermore, the quantity of double-sided adhesive tape that is stuck on can be varied, in order to adjust the force to be applied in order to separate the join.

In another embodiment of the invention, the first packaging material sheet and/or the second packaging material sheet, for the purpose of adhesive joining along the first portion of the periphery of the support element, are coated with an adhesive, at least in the respective first region. It is thereby possible to dispense with a separate adhesive tape. If only a part of a respective surface of the first and/or second packaging material sheet is coated with adhesive, in particular in the respective first region, it also becomes possible, moreover, to prevent one or both of the packaging material sheets from adhering to the pack commodity, for instance the metal sheets, and to remove pack commodity. This development also reliably prevents traces of adhesive from remaining on the pack commodity after removal from the package. Alternatively, in the case of this development, the first and the second packaging material sheet can also be provided with different coatings, which are realized in such a way that an adhesive action is achieved only when these two coatings come into mutual contact.

In the case of a yet further embodiment, the first packaging material sheet and/or the second packaging material sheet, for the purpose of adhesive joining along the first portion of the periphery of the support element, are realized so as to be self-adhesive, at least in the respective first region. This can be achieved, in particular, through an appropriate choice of material for the respective packaging material sheet. For example, a packaging material sheet or both packaging material sheets can be realized as an electrostatically charged film or as a film that, without an adhesive coating, already has favourable adhesion properties. In this way, it is possible to dispense with adhesive tapes and adhesive coatings. The method can therefore be performed in a particularly simple manner and a join of particularly good tightness can be achieved.

According to an improvement of the invention, the first and the second packaging material sheet that overlap in some regions are pressed, in the first region, against one another and against the side surfaces of the support element or against the side surfaces of the pack commodity, in order to promote the adhesive join. This pressing can be effected, for example, by means of a rotating roller guided along the respective side surface, by a likewise moving, rotating round brush, or also by a flat brush that sweeps along the first portion of the periphery of the support element, over the upper side of the second packaging material sheet. It can thereby be ensured that the packaging material sheets adhere cleanly to one another in the first region, as a result of which, in turn, the tightness of the join along the first portion of the periphery of the support element can be improved.

In the case of a development of the invention, the first packaging material sheet and the second packaging material sheet, by being joined along the first portion and along the second portion, are joined to one another substantially along the entire periphery of the support element. A tight closure along the entire periphery of the support element can be realized as a result.

In one embodiment, vertically extending folds that are produced at corners of the pack commodity and that are formed there by surplus material of the first and the second packaging material sheet are laid flatly against the pack commodity and/or the support element, and fastened to the outside of the second packaging material sheet. This fastening can be effected, for example, by applying an adhesive to the fold before it is placed on, by sticking a double-sided adhesive tape onto the fold before the latter is placed on, or by sticking a single-sided adhesive tape over the edge of the fold. As a result, the folds do not project at the corners, do not get in the way during storage, and cannot flutter during transport.

According to an embodiment, after the first packaging material sheet and the second packaging material sheet have been joined, the pack commodity is enclosed on all sides and, in particular, in an airtight and moisture-tight manner. This is particularly advantageous for protecting the pack commodity against the ingress of moisture and dirt.

In the case of an advantageous improvement of the invention, a moisture-binding substance and/or a corrosion-inhibiting chemical that is volatile at a storage temperature of the pack commodity is introduced between the pack commodity and the first packaging material sheet and/or between the pack commodity and the second packaging material sheet. As an alternative to this, in the case of this improvement the first and/or the second packaging material sheet is provided, at least portionally, on a surface facing towards the pack commodity, with such a substance and/or such a chemical, or contain the same. Moisture-binding substances within the package are advantageous, particularly if the pack commodity is closed in an air-tight manner against the external atmosphere, since they make it possible for an atmosphere that is as dry as possible to be maintained within the package. Even if the air mass enclosed with the pack commodity, for example the set of metal sheets, is cooled down by low external temperatures, for example in the case of lorry transport in winter, it is possible to prevent condensation moisture from settling on the pack commodity when the temperature drops below the dew point. Corrosion-inhibiting chemicals, for example so-called VCIs (volatile corrosion inhibitors), by releasing gas during the period of transport and/or storage, enable a protective, corrosion-inhibiting atmosphere to be built up and maintained for a long period between the packaging material sheets and, for example, the packaged metal sheets.

In the case of an embodiment of the invention, the first and/or the second packaging material sheet is/are realized with a plastic film. The plastic film can be, in particular, weldable. Plastic films offer good protection against moisture and also dust, and allow tight joins to be produced.

In the case of an alternative embodiment, the first and/or the second packaging material sheet can also be realized with a paper, in particular a plastic-coated and/or fibre-reinforced paper. Moreover, it can be expedient to select different materials for the first and the second packaging material sheet.

In the case of an embodiment of the invention, the support element is realized as a transport pallet made of wood, plastic or metal. This allows easy handling of the packaged pack commodity, for example by means of a shop truck. In particular, it can also be a pallet having standardized dimensions, which can prove advantageous in transport and storage of the pack commodity.

The above embodiments and developments can be combined with one another in a discretionary manner, insofar as appropriate. Further possible embodiments, developments and implementations of the invention also include combinations, not mentioned explicitly, of features of the invention that have been described previously or are described in the following with regard to exemplary embodiments. In particular, in this connection, one skilled in the art will also add individual aspects as improvements or additions to the respective basic form of the present invention.

The present invention is explained more fully in the following with reference to the exemplary embodiments disclosed in the schematic figures of the drawing.

Of the figures:

FIG. 6 shows a detail B, as indicated in the sectional view of FIG. 2, according to a fourth exemplary embodiment of the invention;

FIG. 7 shows a detail B', as indicated in the sectional view of FIG. 2, according to a fifth exemplary embodiment of the invention;

Figure 1:
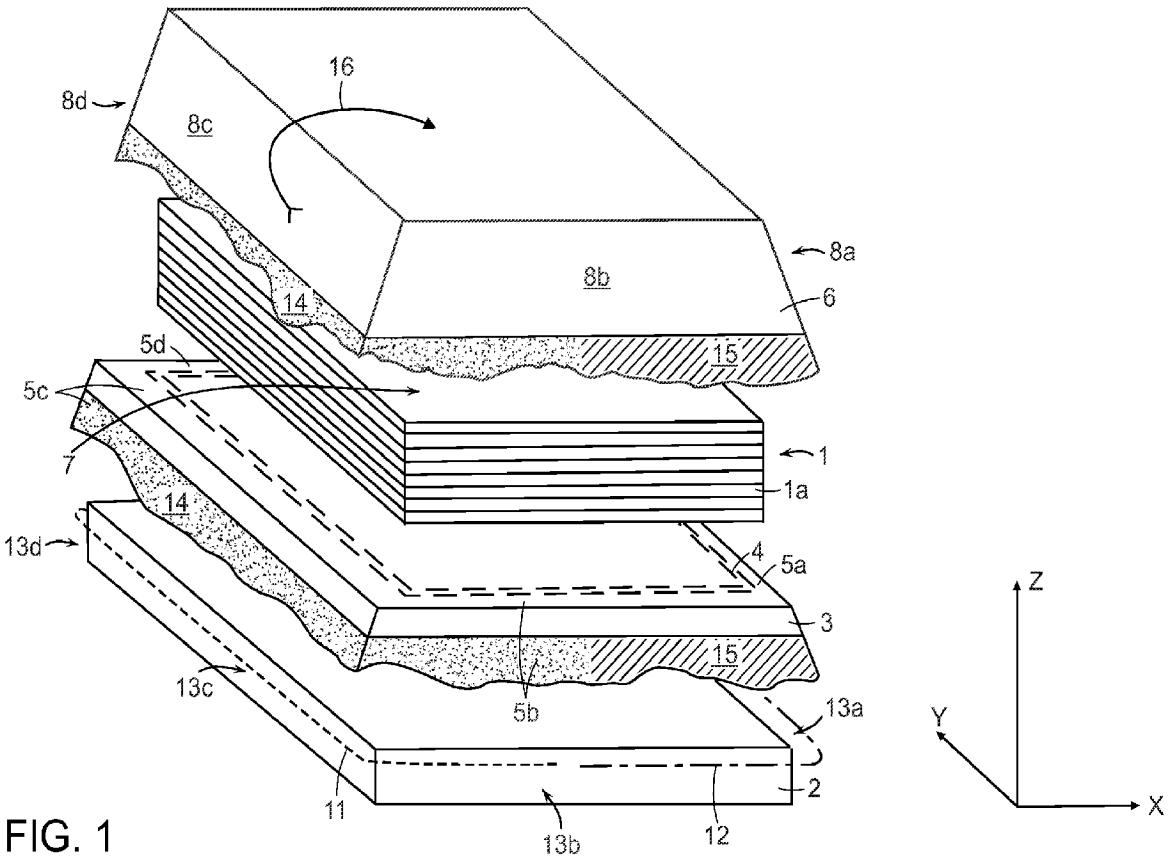
FIG. 1 shows an exploded view of a pack commodity packaged in accordance with a first exemplary embodiment of the invention, for the purpose of illustrating a method according to the first exemplary embodiment of the invention.

In the figures of the drawing, elements and features that are the same or have the same function are denoted by the same references, unless stated to the contrary.

FIG. 1 illustrates, by means of an exploded view, the execution of a method for packaging a pack commodity 1 according to a first exemplary embodiment of the invention. For the purpose of packaging the pack commodity 1, which, in FIG. 1, is represented as a commodity stack constituted by a plurality of commodity pieces 1*a*, for example a plurality of sheet-metal plates of the same type, of which, for the sake of clarity, only one is denoted by a reference, a support element 2 is first provided. The support element 2 serves to support the pack commodity 1 and can comprise, in particular, a pallet, for example made of plastic, wood, metal or other suitable material. A first packaging material sheet 3 is then placed onto the support element 2, for example from above, along a vertical direction Z, as indicated in FIG. 1. The first packaging material sheet 3 can be, for example, a sheet of plastic-coated and preferably fibre-reinforced paper, or a plastic film of suitable thickness and tear resistance. The pack commodity 1 is then disposed on the first packaging material sheet 3. For this purpose, the pack commodity 1 can then be placed, as a complete commodity stack, onto the first packaging material sheet 3 lying on the support element 2, or the commodity pieces 1*a* can be placed on individually. Preferably, the pack commodity 1 is placed on in such a way that that it does not project laterally over the support element 2, although lateral projection of the pack commodity 1 over the support element 2 is also possible. After the pack commodity 1 has been disposed on the packaging material sheet 3, a portion 4 of the first packaging material sheet 3 that is indicated by a double broken line in FIG. 1 is located between the pack commodity 1 and the support element 2. Parts 5*a*-5*d* of the first packaging material sheet 3 protrude over the pack commodity 1. In addition, if the first packaging material sheet 3 is of sufficiently large dimensions, the parts 5*a*-5*d* hang down laterally over the support element 2. In a following step, a second packaging material sheet 6, which can be made of the same material as the first packaging material sheet 3, is placed onto an upper side 7 of the pack commodity 1. In this case, parts 8*a*-8*d* protrude over the pack commodity and hang down laterally from the upper side 7 of the pack commodity 1. The second packaging material sheet 6 can also be realized, for example, with a plastic-coated and preferably fibre-reinforced paper, or with a plastic film. The two packaging material sheets 3 and 6 can be made so as to be transparent or non-transparent, as required, or can also be printed with information or handling instructions or the like.

After that, the first packaging material sheet 3 is joined, in some regions, to the second packaging material sheet 6. This joining is effected along two portions 11, 12, of a periphery of the support element 2, in FIG. 1 the first portion 11 of the periphery being indicated by a dotted line, and the second portion 12 being indicated by a dot-dash line. In the case of the first exemplary embodiment shown, the two portions 11, 12 each extend along approximately half the periphery, in each case adjoining one another approximately in the centre of two opposing side surfaces 13*b*, 13*d* of the support element 2. The two other, likewise mutually opposing side surfaces of the support element 2 are identified by the references 13*a*, 13*c*. Thus, in the case of the first exemplary embodiment shown in FIG. 1, the first and second portions 11 and 12 together comprise substantially the entire periphery of the support element 2. The first and second portions 11, 12 can also extend, however, over portions of the periphery of the support element 2 that are of a different size. Thus, the first portion 11 could be limited, for example, to that part of the periphery of the support element 2 that is assigned to the side surface 13*c*. In this case, the second portion 12 can extend over the side surfaces 13*d*, 13*a* and 13*b*. On the other hand, however, the first portion 11 can also be selected so as to be larger, and to comprise the periphery of the support element 2 in the region of three side surfaces 13*b*, 13*c*, 13*d*, while the second portion 12 remains limited to the fourth side surface 13*d*.

The joining of the first packaging material sheet 3 to the second packaging material sheet 6 is effected, along the first portion 11, in a respective, predetermined region 14 of the first packaging material sheet 3 and of the second packaging material sheet 6 that is identified by stippling in FIG. 1. Further, the joining along the second portion 12 is effected in a respective, predetermined second region 15 of the first packaging material sheet 3 and of the second packaging material sheet 6 that is identified by hatching in FIG. 1. According to the first exemplary embodiment of the present invention, the two packaging material sheets 3 and 6 are joined, in the first region 14, in a manner that differs from the type of join in the second region 15. Along the first portion 11, the packaging material sheets 3 and 6 are joined adhesively to one another in the first region 14. This adhesive join in the region 14 is realized, on the one hand, so as to be tight, for example against the penetration of moist air, dust and water, and, on the other hand, so as to be separable, this being in such a way that, in particular, the two packaging material sheets 3 and 6 can be easily separated from one another by hand, along the portion 11, for the purpose of opening the package, after or during transport or storage. In other words, the two packaging material sheets 3, 6 adhering to one another in the first region 14 can be pulled apart from one another by a person using a force that is easily applied by hand. No knife or similar of any kind is thus required to gain access to the packaged pack commodity 1. Further, it is particularly advantageous if the join in the first region 14 is realized in such a way that the first and the second packaging material sheets 3 and 6, respectively, can be re-joined to one another in an adhesive and preferably also tight manner, without the need for a tool. Consequently, during storage, for example, the pack commodity 1 can be inspected, or partial quantities of the pack commodity 1, for example a plurality of sheet-metal plates 1*a*, can be removed, and the package then re-closed in such a way that, after this, the pack commodity 1, or the rest of the pack commodity that remains, can also continue to be protected against corrosion and soiling.

In the respective second region 15, on the other hand, the first packaging material sheet 3 and the second packaging material sheet 6 are joined to one another along the second portion 12 of the periphery of the support element 2 in such a way that the first and the second packaging material sheets can only be separated again from one another in the second region 15 by destroying the package. In particular, the join in the second region 15 is realized in such a way that the forces to be applied for separating the first packaging material sheet 3 from the second packaging material sheet 6 along the second portion 12 are substantially greater than those forces required for separating the two packaging material sheets from one another in the first region 14.

For the purpose of opening the package of the pack commodity 1 packaged according to the first exemplary embodiment of the invention, the two packaging material sheets 3 and 6 are therefore pulled apart by hand, if possible along the entire first portion 11, in the region 14 as a result of which the adhesive join separates there. If the extent of the first and the second portion 11 and 12, respectively, has been appropriately selected, for example in the manner indicated in FIG. 1, the upper, second packaging material sheet 6 can be folded back in part, in the arrow direction 16, over the pack commodity 1. This affords convenient access to the pack commodity 1, and individual commodity pieces 1*a* can be removed. The join in the second region 15 that cannot be separated without destroying the package is instrumental in enabling the second packaging material sheet 6 to be opened in a practical and convenient manner and to be folded back, and avoids unwanted complete separation of the two packaging material sheets 3, 6 in this case. Even in the case of a relatively large pack commodity, therefore, the two packaging material sheets 3, 6 can be easily opened and folded back by one person, without the packaging material sheets becoming disordered.

Figure 2:
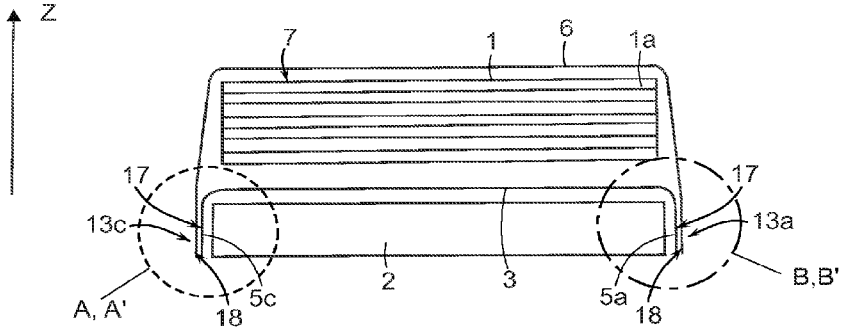
FIG. 2 shows a cross-sectional view of the pack commodity packaged in accordance with the first exemplary embodiment.

The pack commodity 1 packaged in accordance with the method according to the first exemplary embodiment of the invention is represented in a cross-sectional view in FIG. 2.

According to the first exemplary embodiment, the parts of the first packaging material sheet 3 that protrude over the pack commodity 1, of which only the two parts 5*a*, 5*c* can be seen, exemplarily, in FIG. 2, are folded or turned away from the pack commodity 1 and towards the side surfaces of the support element 2. As shown by FIG. 2, here, for example, the protruding part 5*c* of the first packaging material sheet 3 is folded downwards towards the side surface 13*c* of the support element 2, while, on the opposite side of the support element 2, the protruding part 5*a* of the first packaging material sheet 3 is folded against the side surface 13*a* of the support element 2. As a result, particularly in the joining of the first packaging material sheet 3 to the second packaging material sheet 6, an upper side 17 of the first packaging material sheet 3 can be brought into overlapping contact, in the first region 14 and the second region 15, with an underside 18 of the second packaging material sheet 6.

Figure 3:
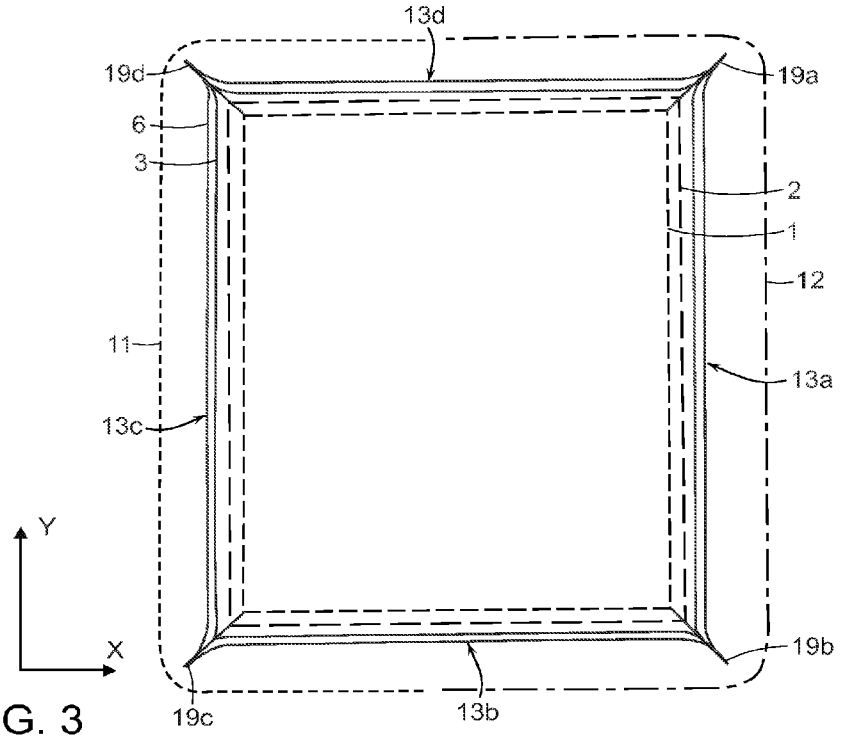
FIG. 3 shows a plan view of the pack commodity packaged in accordance with the first exemplary embodiment.

In FIG. 3, the pack commodity 1 packaged according to the method according to the first exemplary embodiment is shown in plan view, i.e. as viewed from above along the vertical direction Z. Here, exemplarily, as can be seen from FIG. 3, the pack commodity 1 and the support element 2 are realized so as to be substantially rectangular in plan view, the method according to the invention also being applicable, however, in the case of support elements and pack commodities of other shapes, and also being usable, in particular, for packaging a very irregularly shaped pack commodity, for example sheet-metal plates having an outer edge cut to any size, on a pallet that is substantially rectangular in plan view. In FIG. 3, the support element 2 and the pack commodity 1 are covered by the two packaging material sheets 3, 6, and are therefore indicated only by broken lines. The first packaging material sheet 3, placed onto the support element 2, and the second packaging material sheet 6, placed onto the pack commodity 1, are preferably parted off from a sheet material, which, as already explained, can be constituted by a suitable paper or a suitable film that is unwound, for example, from a reel. As a result, it is possible, for example in the region of the corners of the support element 2 and depending on the shape of the pack commodity 1, to use surplus material to produce a fold also in the region of the corners of the pack commodity 1. In FIG. 3, for example, the folds 19*a-d* are produced.

Preferably, the packaging material sheet 3 projects over the pack commodity 1 in the region of all side surfaces 13*a-d*. Likewise, the packaging material sheet 6 is preferably placed on in such a way that the pack commodity 1 is completely covered in its peripheral direction. In this way, after the first packaging material sheet 3 has been joined to the second packaging material sheet 6, the pack commodity 1 can be enclosed on all sides and, in particular, in an airtight, dust-tight and moisture-tight manner.

Figure 4:
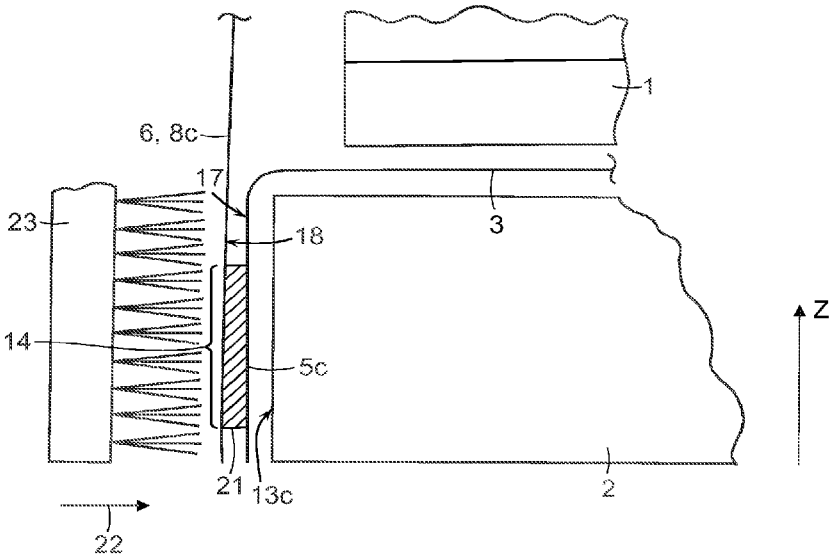
FIG. 4 shows a detail A, as indicated in the sectional view of FIG. 2, according to a second exemplary embodiment of the invention.

FIG. 4 serves to elucidate a method for packaging a pack commodity according to a second exemplary embodiment of the invention. The method and the package produced by means of the method, according to the second exemplary embodiment, have all features of the first exemplary embodiment of the invention, for which reason these features are denoted by the same references as in that embodiment and are not described again in the following. Now, however, in the case of the method and the package in accordance with the second exemplary embodiment, a double-sided adhesive tape 21 is used along the first portion 11 of the periphery of the support element 2 for the purpose of producing the adhesive and separable join in the first region 14. In FIG. 4, the use of the double-sided adhesive tape 21 in the first region 14 is shown in a detail A, whose position lies within the first portion 11 and is indicated in FIG. 2. The double-sided adhesive tape 21 can be already fastened by adhesive bonding, in the predetermined first region 14 of the first packaging material sheet 3, on the upper side 17 thereof, before the first packaging material sheet 3 is placed onto the support element 2. As an alternative to this, it is also possible for the adhesive tape 21 to be adhesively bonded onto the upper side 17 only after the first packaging material sheet 3 has been placed onto the support element 2. Preferably, a protective cover film (not represented) can be left on the second adhesive side of the adhesive tape 21 that is provided for adhesive bonding onto the underside 18 of the second packaging material sheet 6, in the first region 14 thereof, which cover tape is pulled off only when the pack commodity 1 has been completely disposed on the first packaging material sheet 3, the second packaging material sheet 6 has been placed onto the upper side 7 of the pack commodity 1 and the join is to be effected along the first portion 11. In order to promote a tight join between the first regions 14 of the packaging material sheets 3 and 6, it can be advantageous to press these regions against one another in the arrow direction 22. This can be effected by means of a rotating roller, a rotating round brush or also, as illustrated exemplarily in FIG. 4, by means of a flat brush 23 guided along an upper side of the second packaging material sheet 6. Preferably, in the case of this exemplary embodiment of the invention, in the region 14 the double-sided adhesive tape 21 is adhesive-bonded in a continuous length, along the entire portion 11, onto the upper side 17 of the first packaging material sheet 3, in order to achieve a closure that is as tight as possible and that can also be separated again. As an alternative to the above, the double-sided adhesive tape 21 can also first be adhesive-bonded in the first region 14 of the second packaging material sheet 6, on the underside 18 thereof, a cover strip that might be provided on the other adhesive surface of the adhesive tape 21 can be drawn off after the second packaging material sheet 6 has been placed onto the pack commodity 1, and the join between the two packaging material sheets 3, 6 then produced. In the first region 14, the upper side 17 of the first packaging material sheet 3 and the underside of the second packaging material sheet 6 are thus in contact via the adhesive tape 21.

Figure 5:
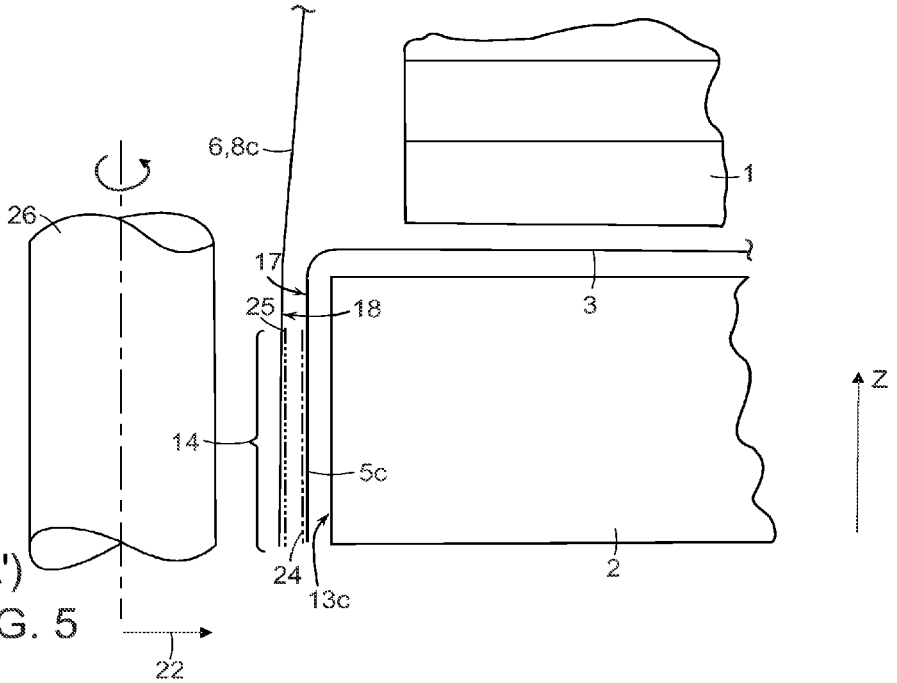
FIG. 5 shows a detail A', as indicated in the sectional view of FIG. 2, according to a third exemplary embodiment of the invention.

A method and a package according to a third exemplary embodiment are elucidated in FIG. 5 on the basis of a detail A', which is likewise identified in FIG. 2. The third exemplary embodiment, likewise, includes all features of the first exemplary embodiment, such that here, also, the same references are used. The third exemplary embodiment of the invention differs from the first and the second exemplary embodiment in that, as shown by FIG. 5, the adhesive join is now produced in that, along the first portion 11, in the respective first region 14, the upper side 17 of the first packaging material sheet 3 and the underside 18 of the second packaging material sheet 6 are coated with a suitable adhesive. This coating can either be already effected before the packaging material sheet 3 is cut to size or, also, during the packaging of the pack commodity 1, for example after both packaging material sheets 3 and 6 have already been placed on. In FIG. 5, the adhesive coatings are denoted by the references 24 and 25. It can also be advantageous, and adequate for a tight join, to provide only one of the coatings 24 or 25. Preferably, the first packaging material sheet 3 is provided with an adhesive coating 24 along the portion 11 of the periphery of the support element 2, in the first region 14, on the upper side 17, while the adhesive coating 25 is dispensed with. Instead of this, however, it is also possible for the coating 25 to be applied, and the coating 24 to be omitted. Moreover, it is possible for the upper side 17 of the first packaging material sheet 3 or the underside 18 of the second packaging material sheet 6 or both to be coated all over with adhesive, whereby a particularly secure adhesive join can be achieved, but whereby adhesion to the pack commodity 1 can also occur. The adhesive used for the coatings 24 and/or 25 is selected, according to this third exemplary embodiment of the invention, in such a way that the join of the packaging material sheets 3 and 6 in the first region is separable and, in particular, can be made to re-adhere by again placing the packaging material sheets onto one another and pressing on them. As a result, the package can be easily opened without a tool, and also closed again in a practical and simple manner. As represented in FIG. 5, according to the third exemplary embodiment of the invention, also, pressing is effected in the direction 22, a rotating roller 26 being shown exemplarily for this purpose in FIG. 5. In a variant of the third exemplary embodiment, instead of the adhesive coatings 24, 25 the first packaging material sheet 3, the second packaging material sheet 6 or both, for the purpose of adhesive joining along the first portion 11 of the periphery of the support element 2, can realized so as to be self-adhesive, at least in the respective first region 14, in that, for example, a film material having special adhesion properties, or an electrostatically charged film, is used for the packaging material sheets. Again, the coating with adhesive or the self-adhesiveness is effected in a continuous length along the entire portion 11, in order to ensure that the packaging material sheets 3, 6 are joined as tightly as possible along the portion 11.

FIG. 6 shows how the join of the packaging material sheets 3 and 6 along the second portion 12 can be effected according to a fourth exemplary embodiment of the invention. Represented for this purpose in FIG. 6 is a detail B, identified in FIG. 2, whose position lies within the second portion 12. The fourth exemplary embodiment, likewise, has all features of the first exemplary embodiment of the invention. The join that cannot be separated without destroying the package produced by means of the method according to this exemplary embodiment, between the first and the second packaging material sheet 3, 6, along the second portion 12, in the respective predetermined region 15 of the first packaging material sheet 3 and of the second packaging material sheet 6, is effected, according to FIG. 6, by stitching both packaging material sheets 3 and 6 jointly by means of a blunt arbor 27. The arbor 27 is pushed in the direction of the arrow 28, for example into the side surface 13*a* of the support element 2, as a result of which the packaging material sheets 3 and 6 are pressed locally into the material of the support element 2 and thereby joined to one another and to the support element 2. The stitching is preferably effected along the entire portion 12. Thus, in the case of this exemplary embodiment, the arbor 27 is also pushed into parts of the side surfaces 13*b* and 13*d*. This stitching can further be effected in the form of a number of stitching points, but also in the form of a continuous or interrupted, straight or, for example, wave-type line drawn along the portion 12 of the periphery. In a variant of the fourth exemplary embodiment, the join in the second region 15, along the second portion 12, can also be achieved with the use of staples. For example, staples can be driven in through the two packaging material sheets 3 and 6, likewise in the arrow direction 28, as a result of which the first and the second packaging material sheet 3, 6 are joined to one another, in particular, for example, so as to be tight against water, moist air or dust, and are fastened to the support element 2.

A fifth exemplary embodiment of the invention is illustrated in FIG. 7 on the basis of a detail B', whose position again lies within the second portion 12 and is indicated in FIG. 2. The fifth exemplary embodiment again includes all features of the first exemplary embodiment, only the join of the packaging material sheets 3 and 6, in the predetermined second region 15, along the second portion 12, being effected by welding. A welding device 31 is used for this purpose, the latter, for example, being able to have a nozzle for applying hot gas to the second region 15 or, for example, to be an electrically heated punch. The welding also can be effected in punctiform or linear manner, in the latter case in a straight line or in a wave-like manner, a linear, continuous-length welding along the entire second portion 12 of the periphery of the support element 2 being preferred for the purpose of achieving a good tightness of the join.

According to a variant that combines features of the fourth and the fifth exemplary embodiment of the invention, it can furthermore also be advantageous for only the first packaging material sheet 3 to be stitched or attached by means of staples, along the portion 12, to the support element 2, for instance to the side surface 13*a* and parts of the side surfaces 13*b* and 13*d*. The second packaging material sheet 6 can then be tightly welded, in the second region 15, along the portion 12, preferably in a continuous length, to the second region 15 of the first packaging material sheet 3, in particular by the action of heat.

It is to be noted, with reference to FIGS. 4, 5, 6 and 7, that the methods, expounded in connection with FIGS. 4 and 5, for joining the packaging material sheets 3 and 6 along the first portion 11 can be applied in any combinations with the methods, explained with reference to FIGS. 6 and 7, for joining them along the second portion 12 of the periphery of the support element 2.

Further, it can also be advantageous for the first packaging material sheet 3 to be additionally joined, along the first portion 11 of the periphery of the support element 2, to the side surface, for example the side surface 13*c*, of the support element 2. This is preferably effected before the adhesive join is produced between the first and the second packaging material sheet 3 and 6, respectively.

As additionally shown by FIGS. 4, 5, 6 and 7, the first and the second region 14 and 15, respectively, are marginal regions of the first packaging material sheet 3 and of the second packaging material sheet 6.

Figure 8:
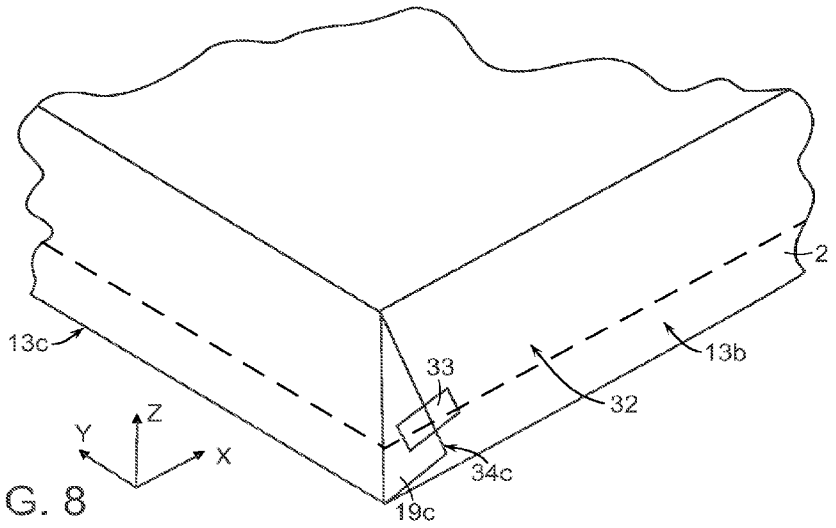
FIG. 8 shows a perspective partial view of a pack commodity packaged in accordance with a variant of the first to fifth exemplary embodiments.

FIG. 8 shows that, in accordance with a variant of the first to fifth exemplary embodiments of the invention, the vertically extending folds 19*a* to 19*d* (cf., in connection therewith, the plan view of FIG. 3), that are produced at the corners and that are formed from surplus material of the first and the second packaging material sheet 3, 6, are preferably laid flatly against the pack commodity 1 or the support element 2 or against both, in particular against the side surfaces thereof, and fastened to an upper side 32 of the second packaging material sheet 6. The fold 19*c* is shown exemplarily in FIG. 8. The fastening of the fold 19*c* is effected, for example, after the join of the packaging material sheets 3 and 6 along the portions 11 and 12 has been produced, by applying an adhesive to one side of the fold 19*c* and then laying this side of the fold 19*c* against the upper surface 32. Alternatively, the fastening can be effected by adhesive-bonding a double-sided adhesive tape onto the fold 19*c* before the latter is laid on, or by sticking a single-sided adhesive tape 33 over an edge 34*c* of the fold 19*c*. Because of the fastening of the folds 19*a-d*, the latter do not get in the way during storage, and they also cannot flutter when being transported on an open lorry. Moreover, the appearance of the package is thereby improved.

Figure 9:
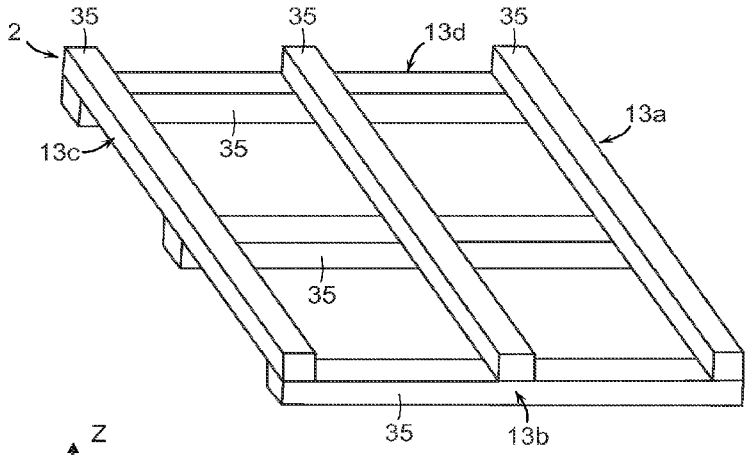
FIG. 9 shows a support element realized as a wooden pallet.

In the case of the exemplary embodiments shown, the support element 2 is preferably realized as a transport pallet made of wood, plastic or metal, this having proved to be advantageous for easy handling of the packaged pack commodity. As shown by FIG. 9, it can be advantageous, moreover, if a support element 2 realized as a pallet has substantially flat side surfaces 13*a*, 13*b*, 13*c*, 13*d* of sufficiently large area, these side surfaces, as in the case of the wooden pallet sketched in FIG. 9, which has, for example, six joined squared timbers 35, definitely also being able to be disposed with an offset in the vertical direction Z. The side surfaces 13*a-d* can serve, on the one hand, in the creation of the adhesive join along the first portion 11, as a bearing surface for supporting the packaging material sheets 3, 6, and allow the packaging material sheets 3 and/or 6 to be satisfactorily fastened to the support element 2, along the second portion 12, if such fastening is provided.

Figure 10:
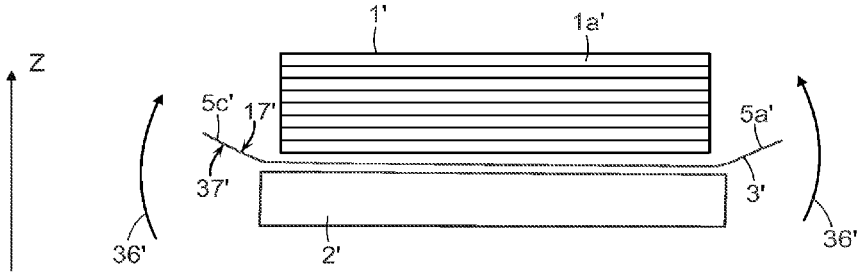
FIG. 10 shows, by means of a cross-sectional view, an intermediate step of a method for packaging a pack commodity according to a sixth exemplary embodiment of the invention.
Figure 11:
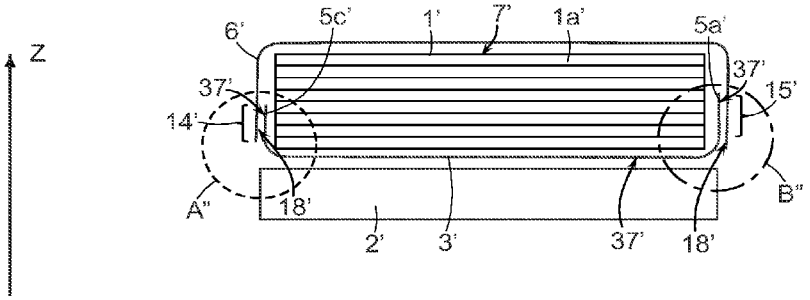
FIG. 11 shows a cross-sectional view of a pack commodity packaged in accordance with the sixth exemplary embodiment of the invention.

FIGS. 10 and 11 elucidate the packaging of a pack commodity 1' comprising commodity pieces 1*a*', according to a sixth exemplary embodiment of the invention. In the case of the sixth exemplary embodiment, also, a support element 2' is provided, onto which a first packaging material sheet 3' is placed. As described with reference to FIG. 1, the pack commodity 1' is disposed on the first packaging material sheet 3'. The pack commodity 1', the support element 2' and the first packaging material sheet 3' are further realized in the same manner as already described with reference to the first exemplary embodiment. According to the sixth exemplary embodiment of the invention, however, in contrast to the embodiments explained above, parts of the first packaging material sheet 3' that protrude over the pack commodity 1', of which only the protruding parts 5*a*' and 5*c*' are visible in the figure, are turned away from the support element 2' and upwards in the arrow direction 36', towards side surfaces of the pack commodity 1'. If the pack commodity 1' has flat sides, as, for instance, in the case of the pack commodity 1' shown in FIG. 10, whose side surfaces extend substantially along the vertical direction Z, the protruding parts 5*a*', 5*c*' can then be laid, advantageously, against the pack commodity 1'. An upper side 17' of the first packaging material sheet 3' now faces towards the pack commodity 1'. As likewise already explained with reference to FIG. 1, a second packaging material sheet 6' is then placed onto an upper side 7' of the pack commodity 1'. According to the sixth exemplary embodiment of the invention also, the first and the second packaging material sheets 3' and 6' are adhesively joined to one another, along a first portion of a periphery of the support element 2', such that they can be separated and, in particular, can be re-joined, and are joined along a second portion of the periphery of the support element 2' in such a way that they can only be separated again from one another by destroying the package. The joining of the packaging material sheets 3', 6' can be effected in the same manner as explained with reference to FIGS. 1 to 7, the sixth exemplary embodiment differing from the preceding exemplary embodiments in that, in the joining of the first packaging material sheet 3' to the second packaging material sheet 6', an underside 37' of the first packaging material sheet 3' is brought into overlapping contact, in the first and second regions 14', 15', with an underside 18' of the second packaging material sheet 6'.

The joining of the packaging material sheets 3' and 6' in a respective, predetermined first region 14', along a first portion of the periphery of the support element 2', and in a respective, predetermined second region 15', as indicated by the details A" and B" in FIG. 11, can be performed as explained above in connection with the first to fifth exemplary embodiments. In the case of the sixth exemplary embodiment, however, the join is produced between the underside 18' of the second packaging material sheet 6' and the underside 37' of the first packaging material sheet 3', which are laid over one another. Moreover, the sixth exemplary embodiment of the invention differs from the preceding exemplary embodiments in that there is no fastening of the packaging material sheets 3', 6' to side surfaces of the support element 2'.

Figure 12:
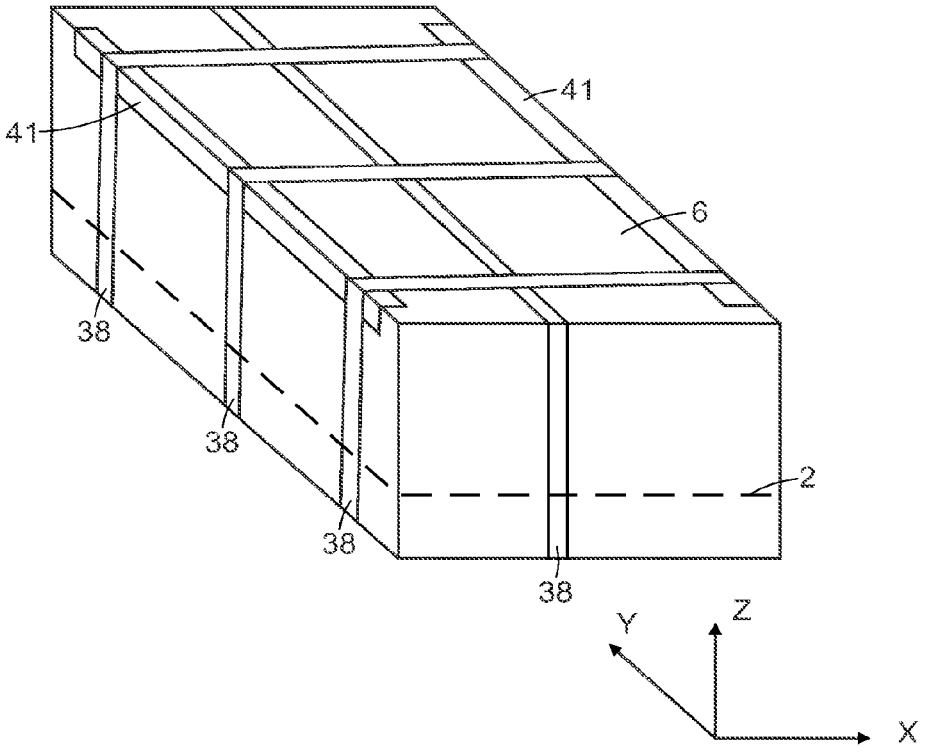
FIG. 12 shows a perspective view of a pack commodity packaged in accordance with a further variant of the first to fifth exemplary embodiments.

FIG. 12 shows a pack commodity that has been packaged in accordance with a further variant of the first to fifth exemplary embodiments. In order that the pack commodity is yet better fixed to the support element 2, after the packaging material sheets 3 and 6 have been placed on and joined the resultant packet is additionally provided with a strapping 38 of steel band or plastic band. In order, in particular, to protect the second packaging material sheet 6 against damage or perforation by the strapping 38, or also against damage during manipulation of the packaged pack commodity, edge protection profiles 41 are provided, in the region of upper edges of the pack commodity, between the second packaging material sheet 6 and the strapping 38. As shown by FIG. 12, these profiles can be realized, for example, as angle profiles made of plastic, sheet metal, cardboard or the like. Such edge protection profiles 41 can also be provided in the case of the package according to the sixth exemplary embodiment.

In the case of all exemplary embodiments described above, it is also possible for the first packaging material sheet 3, 3' or the second packaging material sheet 6, 6' or both to be provided, in their entirety or partially, with an insulating and/or cushioning action. Thus, for example, an air-cushion film, preferably having a substantially smooth surface, can be used for one or both packaging material sheets 3, 3', 6, 6'.

Moreover, there can be advantages in introducing a moisture-binding substance, for example a silica gel or similar, between the pack commodity 1 and the first packaging material sheet 3, 3' and/or the second packaging material sheet 6, 6'. This can be useful in the case of a pack commodity 1, 1' that is sensitive to moisture, or hygroscopic, but has also proved to be advantageous if the pack commodity 1, 1', such as, for instance, a sheet-metal stack, tends to corrode under the action of moisture. Instead of a moisture-binding substance, a volatile, corrosion-inhibiting chemical (also called volatile corrosion inhibitor, or VCI) can be introduced. This can be achieved in that the first packaging material sheet 3, 3', on its upper side 17, 17' that faces towards the pack commodity 1, 1', and/or the second packaging material sheet 6, 6', on its underside 18, 18', is provided, at least portionally, with a moisture-binding substance and/or with a volatile, corrosion-inhibiting chemical. Through the release of gas by the corrosion-inhibiting chemical, a protective atmosphere that surrounds the pack commodity 1, 1' can be produced within the package. Alternatively, for this purpose, the package for the pack commodity 1, 1' produced according to the exemplary embodiments of the invention explained above can also be filled with a suitable protective gas before the joining of the packaging material sheet 3, 3', 6, 6' is completed.

In addition, in the case of all aforementioned exemplary embodiments, within the first portion 11*a* control seal, for example a self-adhesive tear-off strip—not shown in the figures—can be stuck over the join point of the packaging material sheets 3, 3', 6, 6', which control seal tears apart as the package is opened. This can prevent unauthorized removal of commodity pieces 1*a*, 1*a'* from remaining undiscovered.

Although the invention has been described above on the basis of preferred exemplary embodiments, it is not limited thereto, but can be modified in a multiplicity of ways without departure from the subject of the present invention.

In particular, the present invention is not limited to support elements in the form of rectangular pallets or to right parallelepiped pack commodities and commodity stacks. Rather, pack commodities of other shapes can also be packaged, on rectangular or otherwise shaped support elements or bases, by means of the method according to the invention.

Moreover, it is also conceivable not only to provide a first and a second portion of the periphery of the support element, but it can also be expedient, for example, for two first and two second portions to be disposed alternately, the join of the packaging material sheets along the first and second portions being performed as described above.

LIST OF REFERENCES

1, 1' pack commodity
1*a*, 1*a'* commodity piece
2, 2' support element
3, 3' first packaging material sheet
4 portion (first packaging material sheet)
5*a*-5*d* protruding part (first packaging material sheet)
5*a'*, 5*c'* protruding part (first packaging material sheet)
6, 6' second packaging material sheet
7, 7' upper side (pack commodity)
8*a*-8*d* protruding part (second packaging material sheet)
11 first portion (periphery of the support element)
12 second portion (periphery of the support element)
13*a*-13*d* side surfaces (support element)
14, 14' first region (first/second packaging material sheet)
15, 15' second region (first/second packaging material sheet)
16 fold-back direction
17, 17' upper side (first packaging material sheet)
18, 18' underside (second packaging material sheet)
19*a*-19*d* folds
21 double-sided adhesive tape
22 direction of pressing
23 flat brush
24 adhesive coating (first packaging material sheet)
25 adhesive coating (second packaging material sheet)
26 roller
27 arbor
28 push-in direction
31 welding direction
32 upper side (second packaging material sheet)
33 adhesive tape
34*c* edge (fold)
35 squared timber
36' direction of folding (first packaging material sheet)
37' underside (first packaging material sheet)
38 strapping
41 edge protection profile
X horizontal direction
Y horizontal direction
Z vertical direction

The invention claimed is:

1. A method for packaging a product, the product including a product stack formed of a plurality of product units, comprising the following steps:

providing a pallet for carrying the packaged product;

laying a first packaging material sheet on the pallet;

arranging the product to be packaged on the first packaging material sheet in such a way that a portion of the first packaging material sheet comes to be positioned between the pallet and the product to be packaged, and the first packaging material sheet projects beyond the product to be packaged;

laying a second packaging material sheet on an upper side of the product to be packaged in such a way that the second packaging material sheet projects beyond the product to be packaged; and connecting the first packaging material sheet to the second packaging material sheet in regions, the first packaging material sheet and the second packaging material sheet being connected adhesively, so as to be releasable and reconnectable, in a respective predetermined first region along a first portion of a periphery of the pallet.

2. The method according to claim 1, wherein the respective first region consists of edge regions of the first packaging material sheet and the second packaging material sheet.

3. The method according to claim 1, wherein a part of the first packaging material sheet projecting beyond the product to be packaged is folded away from the pallet towards side faces of the product to be packaged, and wherein when the first packaging material sheet is connected to the second packaging material sheet an underside of the first packaging material sheet is brought into overlapping contact with an underside of the second packaging material sheet in the first region.

4. The method according to claim 1, wherein a part of the first packaging material sheet projecting beyond the product to be packaged is folded away from the product to be packaged towards side faces of the pallet, and wherein when the first packaging material sheet is connected to the second packaging material sheet an upper side of the first packaging material sheet is brought into overlapping contact with an underside of the second packaging material sheet in the first region.

5. The method according to claim 4, wherein the first packaging material sheet is additionally connected to the side faces of the pallet along the first portion of the periphery of the pallet.

6. The method according to claim 5, wherein for connection to the side faces of the pallet, the first packaging material sheet is stitched onto the side faces of the pallet by means of a blunt mandrel or stapled thereto using staples.

7. The method according to claim 1, wherein, for adhesive connection along the first portion, a double-sided adhesive strip is applied to the first packaging material sheet or the second packaging material sheet in the respective first region.

8. The method according to claim 1, wherein, for adhesive connection along the first portion of the periphery of the pallet, the first packaging material sheet and/or the second packaging material sheet are coated with an adhesive at least in the respective first region.

9. The method according to claim 1, wherein, for adhesive connection along the first portion of the periphery of the pallet, the first packaging material sheet and/or the second packaging material sheet are formed self-adhesively at least in the respective first region.

10. The method according to claim 1, wherein the first packaging material sheet and the second packaging material sheet are interconnected substantially along the entire periphery of the pallet by way of the connection along the first portion and along a second portion of the periphery of the pallet.

11. The method according to claim 1, wherein the product to be packaged is enclosed on all sides in an airtight and moisture-proof manner, after the first packaging material sheet and the second packaging material sheet are connected.

12. The method according to claim 1, wherein a moisture-inhibiting substance and/or a corrosion-inhibiting chemical which is volatile at a storage temperature of the product to be packaged are introduced between the product to be packaged and the first packaging material sheet and/or between the product to be packaged and the second packaging material sheet, or in that the first and/or second packaging material sheets are provided with a substance of this type and/or a chemical of this type at least in portions on a surface facing the product to be packaged, or it is contained therein.

13. The packaging for a product to be packaged, the product including a product stack formed of a plurality of product units, produced by the method of claim 1, wherein the packaging comprises a pallet, for carrying the product to be packaged, and a first packaging material sheet and a second packaging material sheet, and the first and second packaging material sheets are interconnected in regions, the first packaging material sheet and the second packaging material sheet being connected adhesively, so as to be releasable and reconnectable, in a respective predetermined first region along a first portion of a periphery of the pallet.

* * * * *